US007453406B2

(12) United States Patent
Chenoweth

(10) Patent No.: US 7,453,406 B2
(45) Date of Patent: Nov. 18, 2008

(54) LOW INTERFERENCE INTERNAL ANTENNA SYSTEM FOR WIRELESS DEVICES

(75) Inventor: John P. Chenoweth, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/618,126

(22) Filed: Dec. 29, 2006

(65) Prior Publication Data

US 2008/0158070 A1 Jul. 3, 2008

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS

| | | | | |
|---|---|---|---|---|
| 6,342,869 | B1 | 1/2002 | Edvardsson et al. | |
| 6,507,318 | B2 * | 1/2003 | Ito et al. | 343/702 |
| 6,903,686 | B2 | 6/2005 | Vance et al. | |
| 6,909,402 | B2 | 6/2005 | Vance | |
| 6,924,770 | B2 | 8/2005 | Carpenter et al. | |
| 7,015,863 | B2 | 3/2006 | Sadler et al. | |
| 7,034,769 | B2 | 4/2006 | Surducan et al. | |
| 7,215,289 | B2 * | 5/2007 | Harano | 343/702 |
| 2006/0099914 | A1 | 5/2006 | Andersson | |
| 2006/0111162 | A1 | 5/2006 | Seol et al. | |
| 2007/0164913 | A1 * | 7/2007 | Sakamoto et al. | 343/702 |

* cited by examiner

*Primary Examiner*—Trinh Vo Dinh
*Assistant Examiner*—Dieu Hien T Duong
(74) *Attorney, Agent, or Firm*—Pablo Meles; Akerman Senterfitt

(57) ABSTRACT

A wireless communications antenna system (100) includes a main circuit element (102) having a feed device (104) with an active port (108) and a grounding port (110), where the grounding port is coupled to a grounding device (106) of the main circuit element, a generally planar antenna element (112) having a feeding portion (114) coupled to the active port of the feed device, where the antenna element is electrically ungrounded, and a generally planar secondary circuit element (116) having a grounding portion (118) coupled to the grounding device. The secondary circuit element is positioned in proximity to the antenna element and the antenna element and the secondary circuit element are generally parallel and separated by a gap (X). Further, at least a portion of the secondary circuit element at least partially overlaps the antenna element.

20 Claims, 4 Drawing Sheets

100

100

LOW INTERFERENCE INTERNAL ANTENNA SYSTEM FOR WIRELESS DEVICES

FIELD

This invention relates generally to mobile devices, and more particularly to a low interference internal antenna system for wireless devices.

BACKGROUND

Even though mobile devices increasingly include additional functionality, the size of such devices has been continually reduced, especially telecommunications devices. At the same time, mobile telecommunications providers are increasingly offering multiple voice and data services over various wireless networks, each generally operating on a separate frequency. For example, although a main antenna on a mobile telecommunications device may allow voice and/or data communications over a service provider's network, devices incorporating a Global Positioning System (GPS) device may require the use of a second antenna to properly contact the GPS network to acquire location information if a single antenna cannot operate at both frequencies.

Generally, most mobile communications devices incorporate at least two antennas in order to operate over multiple networks. However, because of the increasingly smaller size of such devices, it is typically required that any necessary antennas be internal antennas. Furthermore, in such smaller devices the antennas must be placed in proximity to each other due to the limited volume of the mobile device, often resulting in not only interference with each other, but also interference with other components of the mobile device. For example, the GPS response of typical internal antennas in some devices is typically poor. Because of the small size of the GPS antennas typically used, there can be significant interference form surrounding electronics, including speakers, integrated cameras, displays, and circuit elements. In general, the solution is to place a GPS antenna or other antenna as far from other components as possible. However, due to increasingly smaller device volumes, such an approach is impractical as it would result in increased device volumes instead.

Therefore, further improvements are desired for a low interference internal antenna system for wireless devices that can improve the performance of internal antennas in mobile wireless devices.

SUMMARY

Embodiments in accordance with the present invention can provide low interference internal antenna systems for wireless devices that provide improved performance internal antennas for a wireless device by increasing the immunity of an antenna to interference from surrounding wireless device components.

In a first embodiment, a wireless communications antenna system is provided. The system can include a main circuit element having a feed device with an active port and a grounding port, where the grounding port can be coupled to a grounding device of the main circuit element. The system can also include a generally planar antenna element portion having a feeding portion coupled to the active port of the feed device, where the antenna element can be electrically ungrounded, and a generally planar secondary circuit element having a grounding portion coupled to the grounding device. The secondary circuit element can be positioned in proximity to the antenna element, where the antenna element and the secondary circuit element are generally parallel and separated by a gap, where at least a portion of the secondary circuit element at least partially overlaps the antenna element. The antenna element and at least a portion of the secondary circuit element can also be are positioned in proximity and perpendicular to an edge of the main circuit element. Furthermore, the planar secondary circuit element can be a flexible circuitry board and at least a portion of the secondary circuit element can positioned in proximity to a lateral edge of the main circuit element.

In a second embodiment, a portable wireless communications device is provided. The communications device can include a primary housing for a main circuit element extending through a portion of the primary housing, where the main circuit element can have a feed device with an active port and a grounding port, which can be coupled to a grounding device of the main circuit element. The primary housing can also include a generally planar antenna element portion having a feeding portion coupled to the active port of the feed device, where the antenna element is electrically ungrounded, and a generally planar secondary circuit element having a grounding portion coupled to a grounding port of the feed device. The secondary circuit element can be positioned in proximity to the antenna element, where the antenna element and the secondary circuit element are generally parallel and separated by a gap and the at least a portion of the secondary circuit element at least partially overlaps the antenna element. The antenna element and at least a portion of the secondary circuit element can be positioned in proximity and perpendicular to an edge of the main circuit element. Furthermore, the secondary circuit element can comprise a flexible circuit board where at least a portion of the secondary circuit element can be positioned in proximity to a lateral edge of the main circuit element.

The communications device can further include a secondary housing hingedly joined to an upper end of the primary housing for providing at least one open and closed position for the wireless communications device. The device can also include a hinge element connected to the primary housing and the secondary housing, where the hinge element extends along an upper end of the primary housing and provides rotation of the one of the primary housing and secondary housing in relation to each other. The hinge element can be positioned in proximity to the antenna elements. The device can further include at least one upper circuit element disposed in the secondary housing, which can be coupled to the grounding device.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The word "exemplary" is used herein to mean "serving as an example, instance, or illustration." Any embodiment or design described herein as "exemplary" is not necessarily to be construed as preferred or advantageous over other embodiments or designs.

DETAILED DESCRIPTION OF THE DRAWINGS

Embodiments in accordance with the invention disclosed herein provide arrangements for providing a low interference internal antenna element system for wireless devices. The embodiments in accordance with the present invention provide an unexpected improvement in performance over internal antenna systems known in the art.

Figure 1:
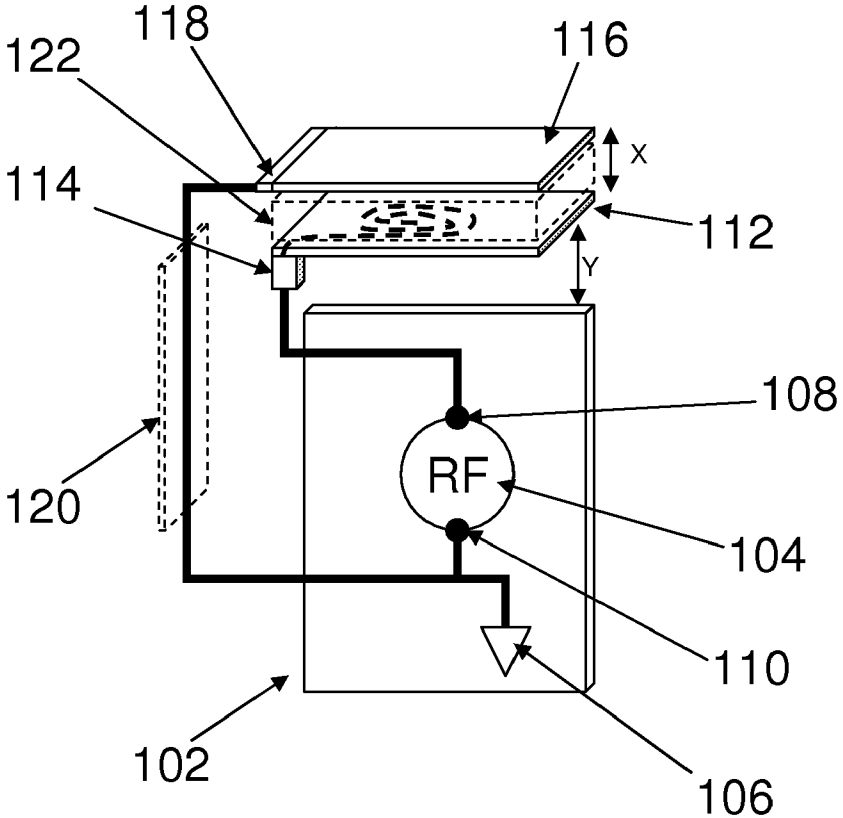
FIG. 1 is an exemplary arrangement of a low interference internal antenna system for wireless devices in accordance with an embodiment of the present invention.

With reference now to the figures, FIG. 1 depicts an exemplary arrangement of a wireless communications antenna system 100 in accordance with the present invention. The wireless communications antenna system 100 can include a main circuit element 102, incorporating a feed device 104 and a grounding device 106. In some embodiments, the main circuit element 102 can comprise a single circuit board; however, the feed device 104 and the grounding device 106 can be distributed over several separate circuit boards working in unison, depending on the application and/or the amount of space available for a wireless communications device.

The feed device 104 can be a radio device for use in a wireless telecommunications system. Radio devices can include any of a transmitter, a receiver, or a transceiver, depending on the application for the antenna system 100. The feed device 104 can include an active port 108 and a grounding port 110. The grounding port 110 can be coupled to the grounding device 106, where the grounding device 106 can be configured to provide a common ground plane for the various components of the wireless communications antenna system 100 or a wireless communications device.

The active port 108 of the feed device 104 can be coupled to a generally planar antenna element 112 configured to resonate at a desired frequency of operation. In the illustrated example, the antenna element 112 is substantially rectangular, however in other embodiments, the antenna element 112 could be other substantially planar designs in order to achieve resonance at a desired frequency or to define other characteristics. For example, a meandering antenna design can be used to increase the antenna length. In the various embodiments, the antenna can be constructed from any electrically conductive material, such as metals. In some embodiments, the antenna element 112 can comprise a free standing conductive element, however in other embodiments, the antenna could comprise a printed conductive element on a printed circuit board (PCB) circuit board. The antenna element 112 can be coupled to the active port 108 through a feeding portion 114 of the antenna element 112. In the illustrated embodiment, feeding portion 114 is member extending from an edge of the antenna element 112, perpendicular to the plane of the antenna element 112. However, the location of the feeding portion 114 or the method of contact can be altered according to the design of the antenna element 112 and performance requirements for the wireless communications antenna system 100.

As previously described, the grounding port 110 can be coupled to the grounding device 106. The grounding device 106 can also be coupled to a separate, substantially planar secondary circuit element 116 through a grounding portion 118. In the illustrated example, the secondary circuit element 116 is substantially rectangular, however in other embodiments, the secondary circuit element can comprise other shapes, according to the design of the wireless communications antenna system 100 or a wireless communication system.

In at least one embodiment, the secondary circuit element 116 comprises a flexible circuit board or "flex circuit". In another embodiment, the secondary circuit element 116 can comprises a top button flex board for a wireless handset. As illustrated in FIG. 1, the grounding portion 118 is located on an edge of the secondary circuit element 116, but the grounding portion could be located elsewhere in the secondary circuit element 116, depending on the application and antenna element 112 characteristics or the arrangement of the feed device 104 or the grounding device 106 on the main circuit element 102

The present invention relies on interaction of the antenna element 112 and the secondary circuit element 116 to provide a tuned low interference antenna system. In the prior art, interference from surrounding components in an antenna element was typically minimized by grounding at least a portion of the antenna element 112, in order to prevent capacitive coupling between and antenna element 112 and a surrounding component. Additionally, grounding the antenna element 112 could also be used to tune the antenna system 100. However, in the present disclosure, capacitive coupling is not only encouraged to reduce interference, but can also used to tune the antenna element 112 to a desired frequency of operation.

To achieve the desired coupling, the antenna element 112 and the secondary circuit element 116 can be positioned in close proximity to each other. By carefully positioning a biased, ungrounded antenna element 112 in proximity to a grounded circuitry area, the antenna element 112 can be controllably and strongly coupled to the secondary circuit element 116, where the coupling capacitance can be used to determine antenna element 112 characteristics, namely the frequency of operation.

Furthermore, the antenna element 112 can become more immune to interference from other components of wireless communications devices, since strong coupling between the antenna element 112 and the secondary circuit element 116 makes it less likely that the antenna element will couple to additional surrounding components, therefore reducing interference from these other components, even when placed in relative proximity to the antenna element 112. Additionally, even if some coupling between the antenna element 112 and another component can be possible, the circuitry gap (X) between the antenna element 112 and the secondary circuit element 116 can be further reduced to increase the amount of coupling, and reduce interference. In some embodiments, the circuitry gap (X) should not be more than a few millimeters (mm) to prevent unwanted interference. However, in at least one embodiment, the circuitry gap (X) can be increased to 8 mm and can still provide effective coupling between the antenna element 112 and the planar secondary circuit element 116, which can allow the antenna element 112 to perform without significant interference from other surrounding components.

Additionally, in at least some embodiments, the design of the antenna element 112 and/or the design the planar secondary circuit element 116 can be configured to further encourage coupling between them or to facilitate adjustment of gap or position when tuning the antenna system 100 or designing a wireless communications device. In at least one embodiment, a spiral shaped antenna element 112 design and a secondary circuit element 116 designed as a button flex board provides adequate antenna performance. However, other designs of the antenna element 112 and/or the secondary circuit element 116 could be used to provide similar or superior antenna performance. Thus, it should be understood that although a rectangular shape is shown in FIG. 1, other embodiments can include various shapes and variations for antenna element 112 and secondary circuit element 116 within contemplation of the scope of the claims herein.

In the illustrated embodiment, the antenna element 112 and the secondary circuit element 116 can also substantially, if not completely, overlap each other. In the various embodiments, the amount of overlap required can be based on the degree of coupling required for the antenna element 112 to operate at a given frequency and the amount of interference from surrounding elements. The antenna element 112 and the secondary circuit element 116 can also be positioned in relation to the main circuit element 102 to prevent the antenna element 112 from inadvertently coupling the main circuit element 102. For example, the antenna element 112 can be positioned perpendicular to the main circuit element 102 to reduce coupling. Additionally, the antenna element 112 and the main circuit element 102 can also be separated by a main board gap (Y). Even though interference can be reduced as the main board gap (Y) is increased, the increase is typically limited due to size constraints of the wireless communications antenna system 100. However, in at least one embodiment, at least a main board gap (Y) of 3 mm is necessary to prevent inadvertent coupling between the main circuit element 102 (or the components therein) and the antenna element 112. Therefore, proper positioning of the antenna element relative to the main circuit element 102 and the secondary circuit element 116 can be used to adjust antenna performance by reducing the probability of capacitive coupling between the main circuit element 102, while maintaining the needed coupling between the antenna element 112 and the secondary circuit element 116.

In the illustrated embodiment, the antenna element 112 and the secondary circuit element 116 can be substantially the same size, however, the size, shape, or dimensions of the antenna element 112 and the secondary circuit element 116 can be different from each other. For example, in a least one embodiment, a secondary circuit element 116 having a total length longer than that of the antenna element can just have a first end or portion of the secondary circuit element 116 overlapping the antenna element 112. In embodiments where a flexible circuit board can be used, at least another portion 120 of the second end of the secondary circuit element 116 can also be brought into close proximity with to the main circuit element 102 without affecting antenna system 100 performance, further reducing the needed amount of space for the wireless communications antenna system 100.

Additionally, a spacer element 122 can be placed between the antenna element 112 and the secondary circuit element 116. The spacer element 122 can be used to provide mechanical support to the antenna element 112, as well as provide a guide for proper placement or alignment of the antenna element 112 in relation to the secondary circuit element 116. The spacer element 122 can be constructed from any non-conductive materials, such as a plastic. In some embodiments, the dielectric constant of the spacer element 122 could be used to further adjust the amount of coupling between the antenna element 112 and the secondary element 116 to further tune the antenna system 100. For example, a spacer element made of a particular dielectric material can be used to enable a desired spacing between antenna element 112 and secondary circuit element 116 that can be closer than just merely relying on an air gap.

Figure 2:
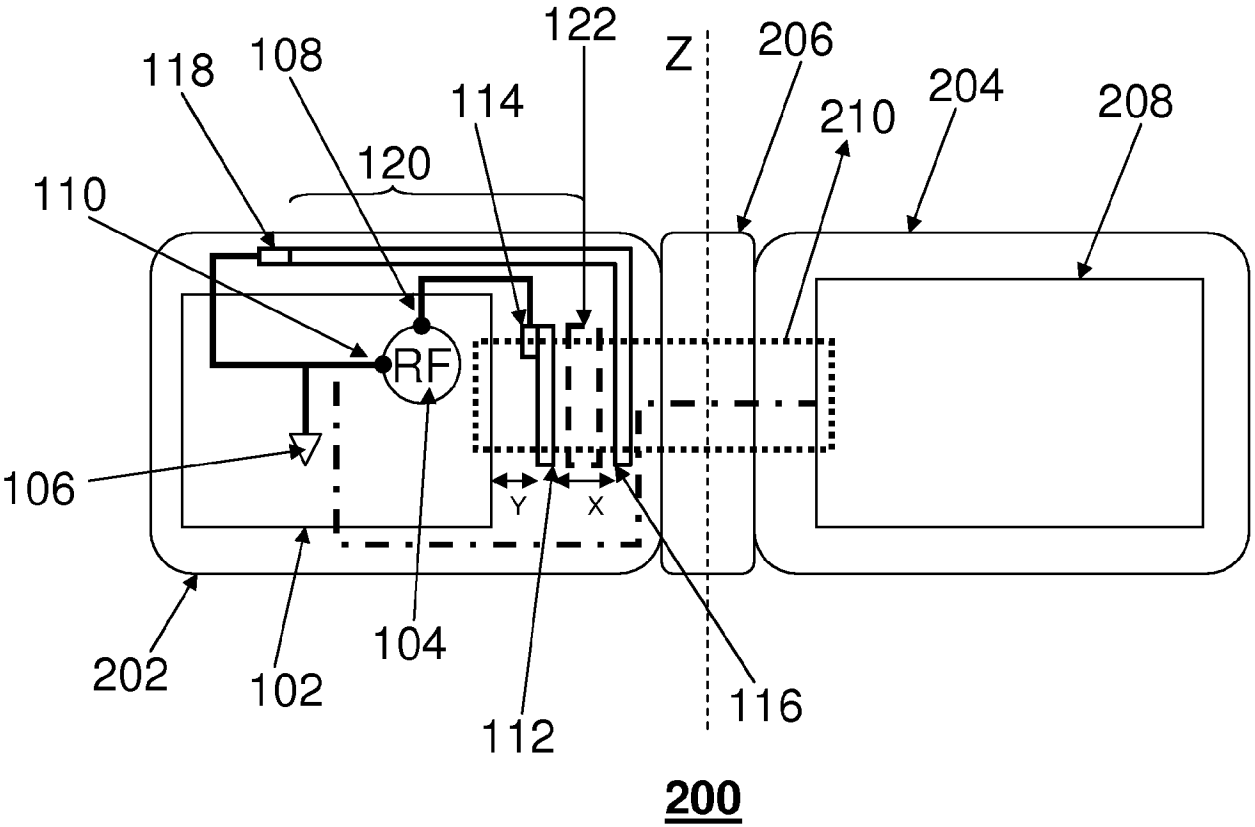
FIG. 2 is an exemplary arrangement a wireless device utilizing a low interference internal antenna system in accordance with an embodiment of the present invention.

FIG. 2 depicts an exemplary arrangement for a wireless communications device 200 utilizing a wireless communications antenna system as illustrated in FIG. 1. The exemplary device 200 comprises a clamshell-type wireless handset device which can include a primary or lower housing 202 and a secondary or upper housing 204 joined by hinge element 206. However, the present invention is not limited to use in only such configurations and could be used in wireless handsets having only a single housing (e.g., a monolith form factor) to provide low interference internal antenna performance.

The lower housing 202 can be configured to enclose the components of the wireless communications antenna system 100 as previously discussed and shown in FIG. 1. As previously discussed, the various components of the wireless communications system 100 can be configured in order to meet the volume limitations of the lower housing 202. In particular, the main circuit element 102 can be adapted to extend through a portion of the lower housing 202. The antenna element 112 and any associated spacer element can also be adapted to fit within the volume constraints of the lower housing 202. In the exemplary device 200, the secondary circuit element 116 can be a flexible circuit board where a first end overlaps the antenna element 112 and a second end or portion 120 of the secondary circuit element 116 can be positioned alongside a lateral edge of the main circuit element 102. Furthermore, the grounding portion 118 of the secondary circuit element can be located near the second end or portion 120 of the secondary circuit element 116, although in other embodiments, the grounding portion 118 could be located elsewhere, as previously discussed.

A hinge element 206 can also be provided to allow one of the lower housing 202 and the upper housing 204 to rotate relative to each other about an axis of rotation (Z), as shown in FIG. 2. The hinge element 206 can allow for at least one open position and one closed position for a clamshell-type phone. However, a wireless communications device 200 in accordance with the present invention can have a hinge element 206 configured to allow the upper housing 204 and the lower housing 202 to have multiple positions relative to each other.

The upper circuitry housing 204 can also further include at least one upper circuit element 208. For example, the upper circuit elements 208 can include, but are not limited to, display components, camera components, additional antenna components, and speaker components. Similarly, the hinge element 206 can contain a hinge secondary circuit element 210 such as a flexible wire connector between the main circuit element 102 and the upper circuit element 208, or any other components which can electrically interfere with the antenna system 100. In the various embodiments, the upper circuit elements 208 or the hinge secondary circuit elements 210 can be coupled to the grounding device 106 of the main secondary circuit element 102, depending on the configuration of the wireless communication device. In such embodiments, the ability to adjust the amount of coupling can be further advantageous in that the ability to increase or decrease the amount of coupling between the antenna element 112 and the secondary circuit element 116 allows the wireless communication device 200 to be further configured to operate with only minimal interference from upper housing 204 and the hinge element 206 and the upper circuit elements 208 and hinge secondary circuit elements 210 therein, respectively.

EXAMPLES

It should be understood that the exemplary wireless communications devices described herein are for illustrative purposes only and that various modifications or changes in light thereof will be suggested to persons skilled in the art and are to be included within the spirit and purview of this application. The invention can take other specific forms without departing from the spirit or essential attributes thereof.

Various wireless communication devices, similar to the clamshell-type device illustrated in FIG. 2 were tested for antenna efficiency and reflection losses ($S_{11}$). The antenna element 112 comprised a substantially rectangular spiral shaped antenna designed for reception of GPS signals. The secondary circuit element 116 comprised a flexible circuit board portion, designed to operate as the top button circuit board for the wireless communications devices. The antenna element 112, the secondary circuit element 116, and the main circuit element 102 were essentially arranged as shown in FIGS. 1 and 2, having the antenna element 112 and the secondary circuit element 116 substantially perpendicular to the plane of the main circuit element 102. The main circuit gap (Y) was 5 mm and the circuit element gap (X) was 2.5 mm. The wireless handset device included a display and a digital camera device integrated into the upper housing 204 and an audio player device and speakerphone capability, along with other components required for standard wireless service and/or push-to-talk service. The measurements were performed at room temperature. Compared to these devices were similar configured devices, but having at least a portion of the antenna element 112 grounded.

Figure 3:
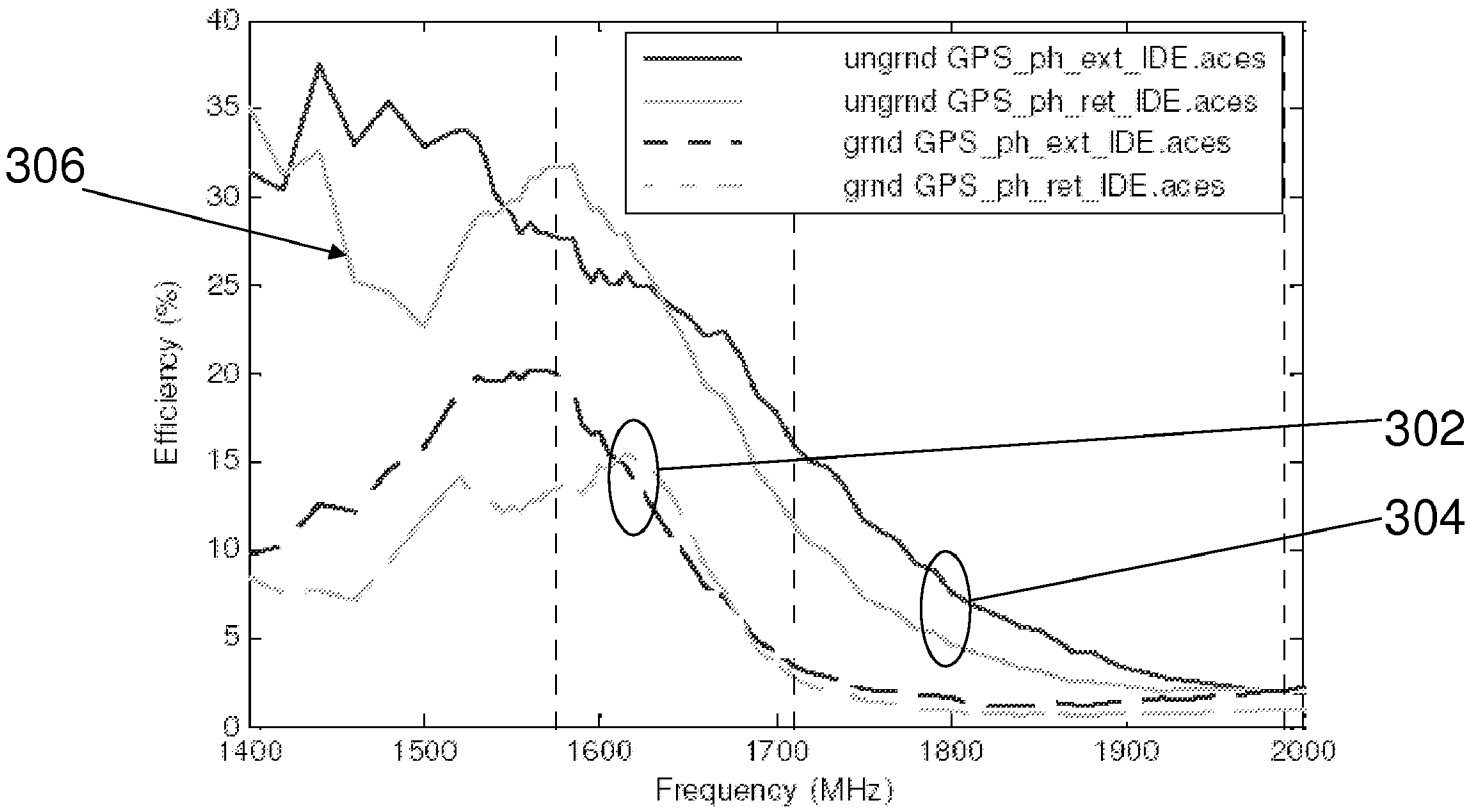
FIG. 3 shows measured free space efficiency for exemplary low interference antenna system devices in accordance with the embodiments and for antenna system devices in the art.

FIG. 3 shows measured free space antenna efficiency data for grounded (dashed lines 302) and ungrounded (solid lines 304) wireless handset devices. As is shown in FIG. 3, over essentially the entire frequency range of 1400 MHz to 2000 MHz, the data collected shows the ungrounded devices having an increase in antenna efficiency over the grounded devices. In FIG. 3, the peak efficiency for the grounded devices was observed at approximately 1575 MHz, achieving only ~20% efficiency. In contrast, the efficiency at the same frequency for the ungrounded devices was ~30% at 1575 MHz. Additionally, the peak efficiency for the ungrounded devices was observed to be between 30% and 35% throughout the range of 1400 MHz to 1600 MHz. In the same band of frequencies, the efficiency for the grounded devices quickly decreased to 10% as frequency dropped below ~1525 MHz.

Figure 4:
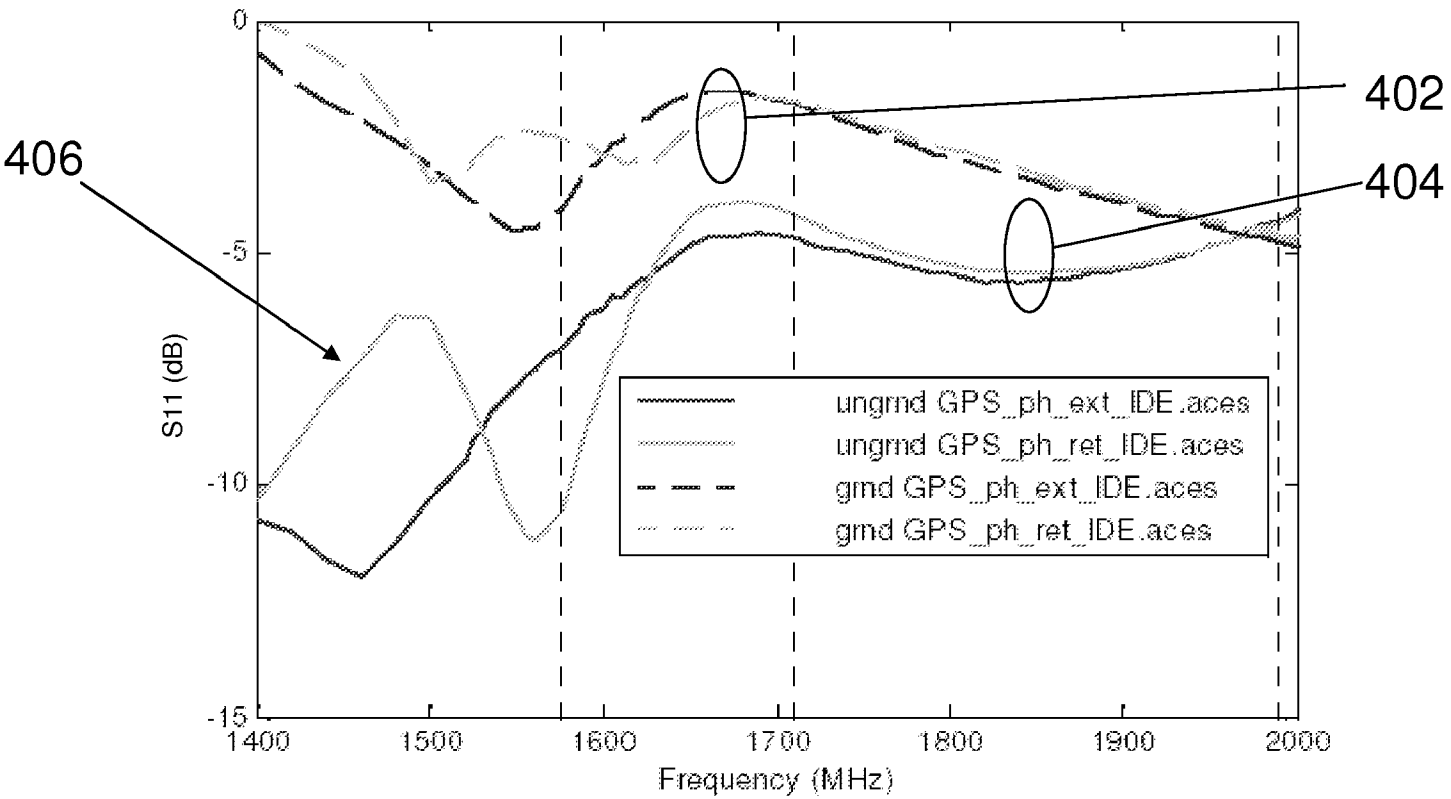
FIG. 4 shows measured reflection loss ($S_{11}$) for exemplary low interference antenna system devices in accordance with the embodiments and for antenna system devices in the art.

FIG. 4 shows measured reflection loss ($S_{11}$) data for grounded (dashed lines 402) and ungrounded (solid lines 404) wireless handset devices. As shown in FIG. 4, over essentially the entire frequency range of 1400 MHz to 2000 MHz, the grounded devices showed poorer measured $S_{11}$ compared to the ungrounded devices. In the frequency range between 1400 MHz and 1700 MHz, the best $S_{11}$ value for the grounded devices was about −5 dB at ~1575 MHz. In contrast, $S_{11}$ values for at least some of the ungrounded devices was about −10 dB or better at ~1575 MHz. In at least one ungrounded device, excellent bandwidth was observed below 1400 MHz and 1500 MHz, showing reflection loss values of −10 dB or better over a bandwidth of 100 MHz or better.

Furthermore, FIG. 4 shows that based on the arrangement of the wireless communications antenna system 100, the antenna element 112 can be configured to resonant at least at two frequencies, as shown in FIG. 4 by dataset 406, in which the antenna system 100 resonates at both ~1400 MHz and ~1575 MHz. Referring to FIG. 3, the associated efficiency dataset 306 shows antenna efficiency at 30% or better at the two resonance points. Therefore FIGS. 3 and 4 show that based on the arrangement used disclosed herein for a wireless communications device 200 and a wireless antenna system 100 disposed therein, an antenna element 112 can be made to resonant at more than one desired frequency and provide good reflection loss and high efficiency values.

It is to be understood that while the invention has been described in conjunction with the illustrated embodiments previously discussed, the foregoing description as well as the examples which follow are intended to illustrate and limit the scope of the invention. Other aspects, advantages, and modifications within the scope of the invention will be apparent to those skilled in the art to which the invention pertains.

What is claimed is:

1. A wireless communications antenna system, comprising:

a main circuit board having a feed device with an active port and a grounding port, wherein the grounding port is coupled to a grounding device of the main circuit board;

a generally planar antenna element having a feeding portion coupled to the active port of the feed device, wherein the antenna element is ungrounded; and a generally planar secondary circuit board having a grounding portion coupled to the grounding device, wherein the planar secondary circuit board is positioned in proximity to the antenna element, wherein the antenna element and the planar secondary circuit board are generally parallel and separated by a gap, wherein at least a portion of the planar secondary circuit board at least partially overlaps the antenna element.

2. The antenna system of claim 1, wherein the antenna element and at least a portion of the secondary circuit board are positioned in proximity and perpendicular to an edge of the main circuit board.

3. The antenna system of claim 2, wherein the secondary circuit board comprises a flexible circuit board.

4. The antenna system of claim 3, wherein a portion of the secondary circuit board is positioned in proximity to a lateral edge of the main circuit element.

5. The antenna system of claim 1, wherein the antenna element is generally spiral shaped and positioned perpendicular to the main circuit board.

6. The antenna system of claim 1, wherein the feeding portion is located on an outer edge of the antenna element.

7. The antenna system of claim 1, wherein the antenna element is generally rectangular and positioned perpendicular to the main circuit board.

8. The antenna system of claim 1, wherein the feed device is at least one among a transceiver, a receiver, and a transmitter.

9. A portable wireless communications device comprising:

a primary housing comprising:

a main circuit board extending through a portion of the primary housing, the main circuit board having a feed device with an active port and a grounding port, wherein the grounding port is coupled to a grounding device of the main circuit board;

a generally planar antenna element having a feeding portion coupled to the active port of the feed device, wherein the antenna element is ungrounded; and a generally planar secondary circuit board having a grounding portion coupled to a grounding port of the feed device, wherein the secondary circuit board is positioned in proximity to the antenna element, wherein the antenna element and the secondary circuit board are generally parallel and separated by a gap, wherein the at least a portion of the secondary circuit board at least partially overlaps the antenna element.

10. The communications device of claim 9, wherein the antenna element and at least a portion of the secondary circuit board are positioned in proximity and perpendicular to an edge of the main circuit board.

11. The communications device of claim 10, wherein the secondary circuit board comprises a flexible circuit board.

12. The communications device of claim 11, wherein a portion of the secondary circuit board is positioned in proximity to a lateral edge of the main circuit board.

13. The communications device of claim 9, further comprising:

a secondary housing hingedly joined to an upper end of the primary housing for providing at least one open and closed position for the wireless communications device; and a hinge element connected to the primary housing and the secondary housing, the hinge element extending along upper end of the primary housing for providing rotation of the one of the primary housing and secondary housing in relation to the other one of the primary housing and the secondary housing around a first axis, wherein the hinge element is located in proximity to the antenna element.

14. The communications device of claim 13, further comprising:

at least one upper circuit element disposed in the secondary housing.

15. The communications device of claim 14, wherein the at least one upper circuit element coupled to the grounding device.

16. The communications device of claim 9, wherein the antenna element is generally spiral shaped and positioned perpendicular to the main circuit board.

17. The communications device of claim 9, wherein the feeding portion is located on an outer edge of the antenna element.

18. The communications device of claim 9, wherein the antenna element is essentially rectangular and positioned perpendicular to the main circuit board and the communications device further comprises a spacer placed between the antenna element and the generally planar secondary circuit board, wherein the spacer is made of a particular dielectric material to enable closer spacing between the antenna element and the generally planar secondary circuit board than just relying on an air gap.

19. The communications device of claim 9, wherein the grounding portion of the portion secondary circuit board is located in the portion of the secondary circuit element in proximity to the lateral edge of the main circuit element.

20. The communications device of claim 9, wherein the feed device is at least one among a transceiver, a receiver, and a transmitter.

* * * * *